United States Patent [19]

Moeller

[11] 3,934,387

[45] Jan. 27, 1976

[54] UNITARY CLIP DEVICE FOR JOINING REMOVABLE CEILING TILE TO HANGER MEMBER

[76] Inventor: Wolfgang Moeller, 4 Glen Cove Drive, Glen Head, N.Y. 11545

[22] Filed: Oct. 21, 1974

[21] Appl. No.: 516,843

Related U.S. Application Data

[62] Division of Ser. No. 392,408, Aug. 30, 1973, Pat. No. 3,875,717.

[52] U.S. Cl. ..... 52/760; 403/406

[51] Int. Cl.[2] ..... F16B 5/06

[58] Field of Search..... 52/760, 489, 758 A, 753 K, 52/753 J, 753 W; 403/406, 407

[56] References Cited

UNITED STATES PATENTS

| | | | |
|---|---|---|---|
| 1,714,681 | 5/1929 | Loucks | 52/760 |
| 2,598,776 | 6/1952 | Flora | 52/760 X |
| 3,552,579 | 1/1971 | Simon et al. | 52/760 X |
| 3,714,752 | 2/1973 | Ratliff | 52/758 A |

*Primary Examiner*—Thomas F. Callaghan
*Assistant Examiner*—Wayne L. Shedd
*Attorney, Agent, or Firm*—Burgess, Dinklage & Sprung

[57] ABSTRACT

An improvement in a suspended ceiling tile construction comprising a generally inverted T-shaped hanger means, a first horizontal portion of which supports a permanent ceiling tile and a second horizontal portion of which extends toward a removable ceiling tile, the generally vertical member of said T-shaped hanger means provided with means to suspend the hanger means from a permanent ceiling, said improvement comprising a clip having an inwardly directed arcuate surface made of a resilient material disposed over a portion of the upper surface of said second horizontal position at the terminal edge thereof a portion of said clips being disposed contiguously in contacting relationship below a portion of a bottom surface of said removable ceiling tile to support the same, said clip having a lip projecting downwardly therefrom, especially a clip where arcuate portion is joined to the portion in contact with the bottom surface of the removable ceiling tile by a contour member disposed along the vertical edge of the removable ceiling tile.

2 Claims, 3 Drawing Figures

FIG. 1.
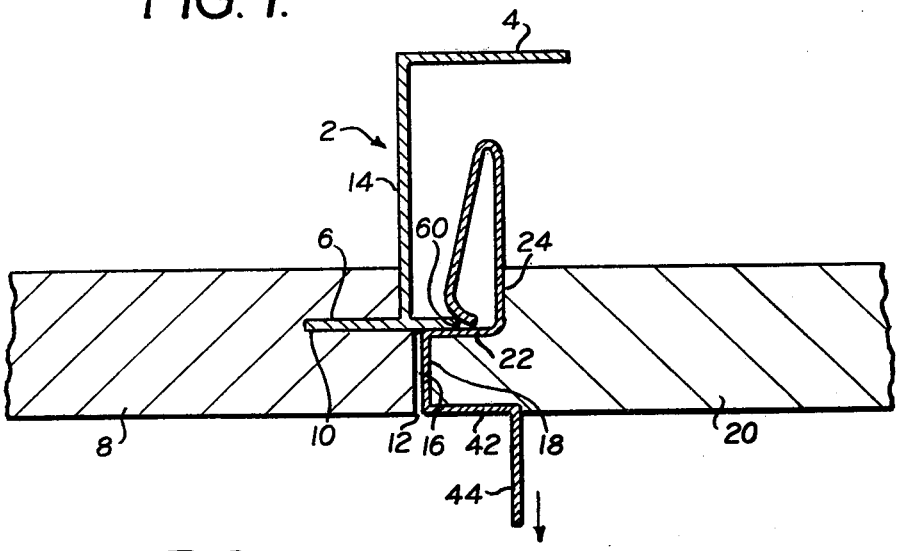
FIG. 2.
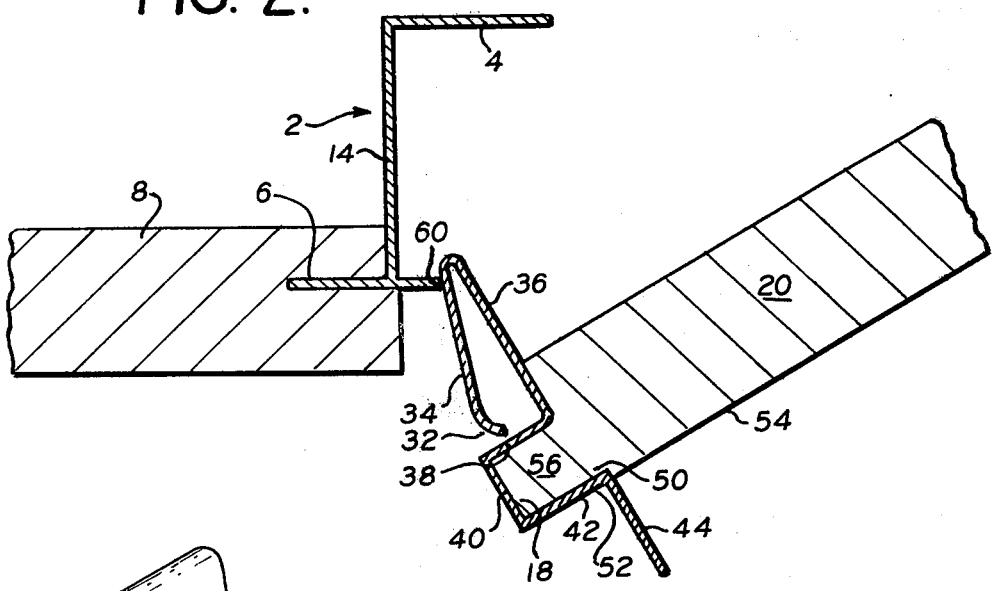
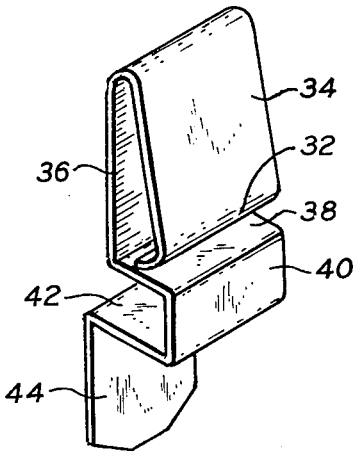
FIG. 3.

UNITARY CLIP DEVICE FOR JOINING REMOVABLE CEILING TILE TO HANGER MEMBER

This is a division of application Ser. No. 392,408 filed Aug. 30, 1973, now U.S. Pat. No. 3,875,717.

BACKGROUND OF THE INVENTION

1. Field of the Invention

This invention relates to suspended ceiling tile construction. More particularly, this invention relates to an improved simple device for removable securing a removable ceiling tile to a stationary ceiling tile disposed in a juxtaposition thereof, both of said ceiling tiles being in a suspended ceiling tile construction.

2. Discussion of the Prior Art

In the assembly of suspended ceiling tiles framed members generally speaking are secured to the permanent ceiling via frames which descend vertically and define what is known in the trade as a Z-bar. The Z-bar is either in the shape of the letter H turned 90°, or in the shape of a Z with the bottom horizontal member extending on either side of the vertical member. Generally, speaking a Z-bar is shown in U.S. Pat. No. 3,276,179. As seen therein the Z-bar is affixed to the permanent ceiling by use of separate clamp means and a suitable fastener such as a screw.

The Z-bar carries the suspended ceiling tiles which are appropriately mounted against the lowermost generally horizontal member. When it is desirous to dispose against a permanent ceiling tile a removable ceiling tile the prior art has provided a bracket means engageable with the Z-bar which is adapted to extend over a portion of the removable panel to be disposed there-against. A threaded member passes through such bracket and through the panel itself. There is positioned beneath the removable ceiling tile a generally circular button which is reciprocally threaded with the vertically disposed threaded with the vertically disposed threaded member so that it can be screwed into the portion of the threaded member extended beneath the removable ceiling tile. The removable ceiling tile is affixed to the assembly by initially placing the bracket in position and moving the ceiling tile into position effecting creation of a hole through the ceiling tile to accommodate the vertically positioned threaded member. When the ceiling tile is in place the generally circular button is screwed onto the portion of the threaded member extending beneath the ceiling tile.

When it is desired to remove the ceiling tile the button must be completely removed from the assembly before the removable ceiling tile can be lowered. When removed the space occupied by the removable ceiling tile still contains the bracket member which extends inwardly from the edge of the permanent ceiling tile. When one bears in mind that a present reason for providing removable ceiling tiles in commercial installation is to provide access to structural members such as wires and airconditioning ducts, it is seen that it is a decided disadvantage to have a projecting bracket in the limited space provided in which to carry out the inspection of or modification to the structural members. Specifically, the average workman can readily harm himself or his clothing when working in such narrow space because he will undoubtedly come into engagement with the relatively permanent bracket on which to fasten and secure the removable ceiling tile via the button.

There is still another decided disadvantage which resides in the fact that the button must be removed free of the balance of the asembly. Bearing in mind its small size it can readily get lost thereby necessitating the replacement of the button and additional nuisance when it is time to reinsert the ceiling tile. A third distinct distant disadvantage of the celing tile construction resides in the fact that it is necessary to make a hole completely through the ceiling tile to accommodate the threaded member. Such is difficult to do without creating a mess and without undoubtedly mutilating the removable ceiling tile.

It is an object of this invention, therefore, to provide a simple means for securing a removable ceiling tile to a permanent ceiling tile. It is an object of this invention to provide a means to secure the removable ceiling tile to the Z-bar or other hanger means whereby the means employed consist of only one part. It is further object of this invention to provide a clip means for securing a removable ceiling tile to a hanger means employed in suspended ceiling tile structure which clip means is removed the removable ceiling tile when the same is removed from the hanger means which carry the common ceiling tile.

SUMMARY OF THE INVENTION

Broadly, this invention contemplates an improvement in a suspended ceiling tile construction comprising a generally inverted T-shaped hanger means, a first horizontal portion of which supports a permanent ceiling type and a second horizontal portion of which extends toward a removable ceiling tile, the generally vertical member of said T-shaped hanger means provided with means to suspend the hanger means from a permanent ceiling tile, said improvement comprising a clip having an inwardly directed arcuate surface made of a resilient material disposed over a portion of the upper surface of said second horizontal portion at the terminal edge thereof, a portion of said clip being disposed contiguously in contacting relationship with a portion of a bottom surface of the said removable ceiling tile to support the same, said clip having a lip projecting generally downwardly therefrom.

In a particularly desirable embodiment there is contemplated such an improved suspended ceiling tile construction wherein the arcuate portion of the clip is joined to the portion in contact with the bottom surface of the removable ceiling tile by a contour member disposed along the vertical edge of the periphery of the removable ceiling tile in facing relationship with the edge of an abutting or facing permanent ceiling tile.

The present invention further contemplates such a clip which clip comprises an arcuate lip of a resilient material, the arc of which faces a generally vertical member of said clip which generally vertical member terminates in a generally horizontal ledge having connected thereto a generally vertical lip member. There is especially contemplated a clip of a continuous resilient sheet material having at one end thereof a terminal arcuate member angularly connected to a generally vertical portion on said clip which generally vertical portion is in facing relationship with said arcuate member, said vertical portion having a generally horizontal portion disposed beneath said vertical portion, said horizontal portion terminating in a second vertical portion, in turn, joined to a horizontal ledge generally parallel to said horizontal portion, said ledge provided with the generally vertical lip.

BRIEF DESCRIPTION OF DRAWINGS

The present invention can be more readily understood and appreciated when reference is made to the accompanying drawings in which:

FIG. 1 is a vertical sectional view of a suspended ceiling construction according to the present invention showing a permanent ceiling tile held by a generally inverted T-shaped member said permanent ceiling tile in facing relationship edge wise with the edge of a removable ceiling tile held in position on the inverted T-shaped member by a resilient clip member;

FIG. 2 is a view similar to FIG. 1 showing the method by which the removable ceiling tile is removed from the hanger means holding the permanent ceiling tile; and FIG. 3 is a perspective view of the clip member disposed along the periphery of the removable tile seen in FIGS. 1 and 2.

DESCRIPTION OF SPECIFIC EMBODIMENTS

Referring to the drawings herein FIG. 1 shows a generally inverted T-shaped hanger means 2 connected to a support for which, in turn, can be connected to a permanent ceiling. The combination of inverted T-shaped member 2 and horizontal member 4 can be considered as the Z-bar. For the description of the present invention it is only necessary to consider that portion of the Z-bar which represents an inverted T or a horizontal leg thereof. There is disposed about a first horizontal portion 6 of the inverted T member 2 a permanent ceiling tile 8. Permanent ceiling tile 8 contains a groove 10 of a size corresponding to the thickness of the first horizontal member 6. Ceiling tile 8 has a lower lip 12 which is disposed beneath the vertical section 14 of the generally inverted T-shaped hanger means 2.

In facing relationship with the edge 16 of the permanent ceiling tile 8 is an edge 18 which constitutes one of the vertical edges of the removable ceiling tile 20. Removable ceiling tile 20 comprises the first vertical edge 18, a horizontal portion 22 and a generally vertically portion 24. Disposed about the periphery of the terminal edge of removable ceiling tile 20 is a clip member of the present invention which is a generally strip material of a resilient substance formed in the configuration shown in FIG. 3.

Referring to FIG. 3 which shows the clip member from the opposite direction to that shown in FIGS. 1 and 2, the clip member has an arcuate lip 32 and rises angularly by a surface 34 to meet a generally vertical portion 36 which terminates in a first horizontal portion 38. Horizontal portion in turn is connected to a second vertical portion 40 which in turn terminates into a horizontal ledge 42 which is generally parallel to horizontal portion 38. Disposed on horizontal ledge 42, such as the end thereof, is a generally vertical lip member 44.

Referring to FIGS. 1 and 2 the clip member of FIG. 3 is inserted over the edge 18 and overlies the vertical portion 22 of the removable ceiling tile 20. The horizontal ledge 42 of the clip member is disposed beneath a bottom surface of the removable tile 20 so as to run contiguously therewith over a portion of the surface. The horizontal ledge 42 is in contacting relationship with a portion 50 of the bottom surface of the removable ceiling tile 20. In actual practice the lower surface 52 of the horizontal ledge 42 will be in general aligned with the lower surface 54 of the main portion of the removable ceiling tile 20. The horizontal portion 38 and the horizontal ledge 42 are so sized as to receive the edge member or portion 56 of the removable ceiling tile 20. The interconnecting second vertical portion disposed between horizontal portion 38 and horizontal ledge 42 runs along and is contiguous and in contacting relationship with the facing edge 18 of the removable ceiling tile 20.

The clip member has an arcuate portion 32 which lies over a terminal edge 60 of the second horizontal member of the generally inverted T-shaped hanger means. The material of the clip member is resilient so that when the clip is in position as shown in FIG. 1 and a force is applied in the direction of the arrow shown therein as by pulling on the generally vertically extending member 44 the strip material of the clip will deformed inwardly inasmuch as the material of the portion 34 of the clip is resilient. This deformation will be of sufficient magnitude to allow the clip member to be removed free the terminal edge 60 of the heart of the second horizontal portion of the generally inverted T-shaped hanger member.

Similarly when the removable ceiling tile 20 is to be reinserted the resilient surface of the angularly disposed member 34 will be such as to permit such surface to be deformed inwardly towards the generally vertical surface 36. When the generally inwardly directed arcuate surface 32 reaches the terminal edge 60 of the second horizontal portion of the generally inverted T-shaped hanger means, the same will deform inwardly until the terminal edge of the arcuate portion 32 overlies the terminal edge 60 of the horizontal portion facing the removable ceiling tile 20.

It is therefore seen that the clip member of the present invention is a single unitary piece of a resilient material. It is readily applied to the edge of currently employed removable ceiling tiles merely by disposing the same along the contour as shown in FIG. 2 and slightly wrapping the same to lodge it in contacting relationship with the edge of the removable ceiling tile 20. No additional procedures are required to dispose the same in operative relationship to the entire suspended ceiling tile assembly. The ceiling tile is then raised in the position shown in FIG. 2 to that of the position of FIG. 1.

The clip member of FIG. 3 is made of a resilient material. As such it can be made of numerous available materials including synthetic polymer materials as well as metals. The lip member 44 can be of different colors so that each color can represent a different function disposed between the permanent ceiling and the ceiling tile. Thus, when the personnel of a building want to locate, for instance, plumbing lines they look for the color on vertical lip 44 corresponding to plumbing lines. The lip 44 is then engaged and pulled slightly in the direction of the arrow shown in FIG. 1 to dislodge the removable ceiling tile 20 from the position shown in FIG. 1 to that of FIG. 2.

It will be understood that other constructions are possible within the scope of the present invention. Thus, the drawings depict a particular desirable mode wherein the arcuate portion of the clip is joined to that portion underlying the removable ceiling tile by portions which run along the edge contour of removable ceiling tile and are in facing relationship with the edge 16 of the permanent ceiling tile. However, is also contemplated that the vertical portion 24 descends throught the body of the removable ceiling tile 20. A horizontal portion is then provided at the terminal edge thereof to support a portion of removable ceiling tile 20. Such horizontal portion is provided with a lip member descending generally vertically therefrom but to serve as a ledge which is grasped. In such embodiment the clip works essentially the same as the embodiment shown in FIGS. 1 through 3. The ceiling tile is dislodged by virtue of the resilient cam-like action which occurs at the arcuate portion 32 facing the terminal edge 60 of the second horizontal portion of the inverted T-shaped hanger means 2. Naturally, the horizontal portion disposed along the bottom age of the ceiling tile 20 can run in either direction i.e. it can run towards the space between the paneling ceiling tile and the removable ceiling tile or it can run in a direction opposite thereto. In either event the removable ceiling tile is readily removed from the inverted T-shaped bracket. The clip member stays positioned on to the removable ceiling tile and does not present an obstruction when a worker insert his hands into the space provided by the removal of the removable ceiling tile 20. Therefore, the operation is as safe as the general construction provides. Accordingly there is provided a simple effective unitary ceiling tile construction wherein the clip member employed to engage the removable ceiling tile comprises only one part and thus there is no problem of parts being separated from one another as is the case in the construction of U.S. Pat. No. 3,276,179.

Other advantages of the present invention will be obvious to one of still in the art after having viewed the above disclosure.

Thus, the terms and expressions used herein have been used as terms and expressions of illustration and not of limitation as there is no intention, in the use of such terms and expressions, of excluding any equivalents, or portions thereof, its various modifications and departures from the above disclosure will become apparent to one skilled in the art.

The clip can of course be used in system having other than an inverted T structural hanger member. For instance they can be used when a Z bar is used in which case the clip engages over the horizontal member as described. Thus the invention can be considered to reside in a suspended ceiling tile construction having a hanger member having a generally horizontal lip extending toward a removable ceiling tile said construction having a permanent ceiling tile abutting said hanger member on one side thereof and said removable ceiling tile abutting said hanger member on the other side thereof said construction improved by a clip having an inwardly directed arcuate surface made of a resilient material disposed over a portion of the upper surface of the horizontal lip at the terminal edge thereof a portion of said clip being disposed contiguously in contacting relationship below a portion of a bottom surface of said removable ceiling tile to support the same said clip having a lip projecting downwardly therefrom.

What is claimed is:

1. A unitary clip made of a resilient material adapted to detachably hold the edge of a ceiling panel to a supporting beam, said clip comprising a body portion and a resilient catch portion, the catch portion being integral with and extending retrorsely at an acute angle from one end of a first straight section of said body portion and terminating in an arcuate tip which faces said first section, the other end of said first section terminating in a first ledge extending generally perpendicularly from said first section, under and somewhat beyond said arcuate tip, there being a small clearance between said arcuate tip and said first ledge, thereby providing for free swinging movement of said resilient catch portion; a lip member integrally connected to and extending generally perpendicularly away from the end of said ledge distal from said first section and in a direction parallel to and away from said first section, a second ledge extending from the other end of said lip generally parallel with and opposed to said first ledge, whereby the spacing between said ledges is adapted to receive an edge of a panel to be held and said arcuate tip is adapted to be deflected toward said first straight section and to springingly engage said supporting bearing, said arcuate tip serving as a cam to release said catch in response to a force applied in a direction away from said panel.

2. A clip according to claim 1 wherein a tab is attached to said second ledge which extends perpendicular therefrom generally parallel to said first section.

* * * * *